United States Patent [19]

Merritt

[11] 4,028,985

[45] June 14, 1977

[54] PITCH DETERMINATION AND DISPLAY SYSTEM

[76] Inventor: Lauren V. Merritt, 95 Monte Vista Lane, Sierra Madre, Calif. 91024

[22] Filed: Feb. 17, 1976

[21] Appl. No.: 658,366

[52] U.S. Cl. ..... 84/454; 84/464; 324/78 R

[51] Int. Cl.[2] ..... G10G 7/02

[58] Field of Search ..... 84/464, 454; 324/78 R, 324/78 D, 83 R, 83 D

[56] References Cited

UNITED STATES PATENTS

| | | | |
|---|---|---|---|
| 2,779,920 | 1/1957 | Petroff | 84/464 X |
| 3,204,513 | 9/1965 | Balamuth | 84/454 X |
| 3,662,261 | 5/1972 | Barthold et al. | 324/78 R |

*Primary Examiner*—Ulysses Weldon
*Attorney, Agent, or Firm*—Arthur V. Doble

[57] ABSTRACT

An improved system for the determination of pitch or perceived frequency of signals generated by musical instruments or voices and for the display of the results in a format easily understood and used by musicians. An incoming signal from a microphone is peak detected after amplification, then further processed by rejecting spurious peaks through the use of an inhibit circuit which sends onward acceptable pulses and inhibits those pulses which arrive during a period immediately following each accepted pulse, the period being approximately ⅜ of the time between acceptable pulses. These pulses drive a period measuring circuit which provides a signal proportional to the time between input pulses, the signal being fed back to the inhibit circuit for its proper operation and being fed forward to the readout display where the results are translated into convenient musical notation, like $C_{+1}$ #. The display further subdivides the standard 6% musical pitch increments in 2% increments so that slightly sharp or flat indications can be provided for the use of the musician.

10 Claims, 6 Drawing Figures

SIGNAL 1: DIRECT FREQUENCY; $S_1 = \sin 2\pi ft$

SIGNAL 2: CARRIER FREQUENCY; $S_2 = [\sin 2\pi 6ft][1 - \frac{1}{2}\sin 2\pi ft]$ $S_2 = \sin 2\pi 6ft - \frac{1}{4}\cos 2\pi 5ft + \frac{1}{4}\cos 2\pi 7ft$

SIGNAL 3: PEAK DETECTOR OUTPUT PULSES DUE TO SIGNAL 2

PITCH DETERMINATION AND DISPLAY SYSTEM

BACKGROUND OF THE INVENTION

1. Field of the Invention

This invention relates to musical training aids in general and more particularly to devices for determining pitch or perceived frequency of signals generated by musical instruments or human voices.

2. Description of the Prior Art

Various machines that indicate the pitch produced by a musical instrument have been of interest for considerable time. Patents for such devices date from at least 1933. Early devices used mechanical means such as vibrating reeds to make the measurement or displayed the results of the measurement by means such as electrical meter movements. Later inventors turned to electronic equivalents of these mechanical devices. But a multiplicity of tuned filters or quartz reference crystals has the same problems of a multiplicity of vibrating reeds; i.e. precision elements are expensive and multiples of precision elements are multiply expensive. Electrical meter movements have been replaced, for example, by oscilloscopes which have the same limitation; i.e. while being able to display pitches over a single octave range (a 2X change in frequency) with fair accuracy, they cannot display large ranges having a plurality of octaves. A display that will cover the range of two octaves below Middle C to two octaves above Middle C must handle a 16X range of frequencies.

A detailed discussion of the limitations of various technologies previously used in pitch measuring and display systems would imply that their respective corresponding underlying assumptions are correct, but they usually are not. Previous inventors of pitch measuring devices often have not understood the full scope of the problems that they were trying to solve. They therefore generally developed equipment which could not achieve the desired results. The most common errors made by them are listed below with a more detailed discussion following thereafter:

a. Failure to recognize that the perception of musical pitch is a logarithmic phenomenon, not a linear one. Thus, the attendant display must be one which is intrinsically logarithmic.

b. Failure to recognize that the perception of musical pitch involves automatic switching between direct frequency and carrier frequency operations. Any equipment that might supplant the human ear must be equally flexible.

c. Failure to recognize that the production of a precise musical pitch is sufficiently difficult so that any equipment that attempts to assist the effort should be made to be extremely simple to operate and use.

Concerning the perception of musical pitch as a logarithmic operation, the following discussion is pertinent. Middle C is the musician's term for a pitch having a frequency of 256 Hz. The next higher C is at a frequency of 512 Hz while the yet next higher C has a frequency of 1024 Hz. It is to be noted that an error of 5 Hz is a 2.0% error at Middle C, but represents 1.0% error at the C an octave up and a 0.5% error at 1025 Hz. Thus, beat frequency display devices do not represent an optimum nor even a totally useful approach. It is difficult for a trained singer to sing with an accuracy in pitch of better than 2%. Furthermore it is difficult to hear beats much higher than 5 Hz, particularly while concentrating on singing a correct pitch. Thus, hearing a beat frequency for a 2% error at Middle C is difficult, but hearing the 5 Hz error at the C above Middle requires singing at a pitch accurate to 1%, which is effectively impossible, even for the trained singer. The beat frequency approach has no practical utility at all at two octaves above Middle C because the human being is not capable of singing at pitch accuracies of 0.5%.

Electrical meter movements have problems with logarithmic operation or application. A common frequency measuring technique is to generate a voltage linearly proportional to the received frequency and apply this voltage across a meter movement. If 1024 Hz is equivalent to 1.0 volts, 512 Hz would be 0.5 volts and 256 Hz would be 0.25 volts. A meter reading 1.0 volts full scale, and swinging a total of 100 mechanical degrees, would spend half of its swing covering the top sung octave, while the lower octave would occupy only 25%, or 25°, of the swing range. While it might be possible to spot a 2% error at the highest note, which would correspond to 2° swing, it would be extremely difficult to perceive a 2% error at the position of the lowest note since the corresponding amount of motion is only ½°. Techniques for zero supression can be used to improve this readability problem with the obvious drawback that range capability is lost. No one has yet demonstrated the thought of doing a logarithmic conversion of the generated voltage before applying it to the meter movement. In that instance, 1024 Hz could be 1.0 volts and 512 Hz would be 0.5 volts, 526 Hz would be 0.0 volts. In that instance, percentage errors would be evenly distributed over the range of meter motion.

Next, the Carrier Frequency Operation is herein examined. The human voice at high frequencies vibrates in a fashion similar to the vibration of a stringed instrument or a tight rubber band. Corresponding electrical signals are easy to decode by resonant reed or multiple tuned circuits machines. The mathematical expression describing the signal is:

| | |
|---|---|
| $S = A \text{ sine } 2\pi ft$ | S is signal strength<br>A is some amplitude<br>$\pi$ is 3.1416<br>f is frequency<br>t is time |

At low frequencies, however, chest cavity resonances amplitude modulate the vibrations of the vocal chords. A mathematical expression demonstrating the effect of this amplitude-modulated carrier frequency is:

$$S = A \text{ (since } 2\pi f_1 t) \text{ X (sine } 2\pi f_2 t)$$

where $f_1$ is the frequency of vibration of the vocal chords, which serves as the carrier frequency, and $f_2$ is the amplitude-modulating information frequency. Human pitch perception will always respond to the lower of these two frequencies. Multiple tuned circuits will respond to the mathematically equivalent signal of:

$$S = A/2 \text{ (cosine } 2\pi(f_1 + f_2)t - \text{cosine } 2\pi(f_1 - f_2)t \text{ )}$$

thereby indicating the sum and the difference of the frequencies, neither of which may be anywhere near the correct frequency. It would be possible to build a computer-controlled pitch detector which would compute the lower of the two fequencies when sum-and-difference frequencies are present. But there are more than just two frequencies in the human voice or in any instrument such as a trombone or trumpet. Thus, multiple tuned filter systems only have limited usefulness.

Finally, one must look at ease of operation. The ease with which a machine should operate cannot be determined without consideration of the skills and interests of the final user. A musician is trained to think in terms of musical notes and in correcting deviations from those precise notes whenever he is sharp or flat. While he may know that the A above Middle C has a frequency of 440 Hz, he cannot reasonably be expected to know the frequency of any other note or notes, particularly in rapid succession. While his knowledge of frequency is generally very limited, his knowledge of periods is probably non-existent; and that a frequency of 440 Hz corresponds to a period of 2.27 milliseconds is normally beyond his realm of experience. Thus, oscilloscope displays of the periods of signals, while interesting to a person skilled in electronics, are useless to a musician. As another example, a ring of lamps that flash in a clockwise or counter-clockwise fashion when a tone is sharp or flat requires the musician to think in terms of right or left rotation. Since this is foreign to his training and a sharp and a flat more generally correspond to a high and a low, or an up and a down, a single sharp indicator located above a single flat indicator is a more natural arrangement and would be more useful over the rotating ring approach.

The circumstances in which a pitch-measuring instrument might be used should also be considered. If one imagines the musician to be reading some sheet music while playing an instrument or singing, and using the pitch measuring instrument to tell him how he is doing, one must understand that his concentration is on the music. The pitch-measuring instrument should not disturb this concentration any more than necessary. Thus, to require him to sweep his eyes across an electrical meter movement to see where the needle is pointing, and then to ask him to decide for himself how far off the mark the needle may be before his redition is unacceptable, is requiring too much of a performing musician. The pitch readout should be in one place, so its position is known. Beside displaying the basic note, the ideal pitch-measuring instrument should indicate sharp or flat only when the musician is sufficiently far off so that something needs to be done to assist him in returning to an acceptable threshold of pitch deviation. Applicants apparatus will make provision for these requirements.

SUMMARY OF THE INVENTION

An earlier disclosure of this invention demonstrating one embodiment thereof is contained in a Patent Office Disclosure Document, no. 35249, date stamped Sept. 10, 1974 by the Patent Office.

A musical instrument or a human voice produces a signal picked up by a microphone, is amplified to a convenient amplitude and is then peak detected. Spurious peaks are rejected by use of the following techniques. First, the decay time of an RC inhibit circuit prevents the detection of other peaks substantially lower in amplitude than the immediate previous peak. Then, peaks produced sooner than approximately ⅜ of the last measured time between accepted peaks after the last accepted peak are rejected. The time between accepted peaks is measured to such sufficient resolution that the display can show the user the frequency being produced to an accuracy of plus or minus 1%. The display provides the standard musical notation closest to the measured pitch, like $C_{+1}$ # , in addition to subdividing the standard 6% musical pitch increment into three equal sections so that slightly sharp or slightly flat pitches can be indicated for the musician's use.

Accordingly, it is an object of this invention to provide an improved method and apparatus for pitch determination and its display.

It is an object of this invention to provide a musician, particularly beginning musicians, whether they are vocalists or instrumentalists, with rapid and accurate information about the pitch they are producing.

It is a further object to provide pitch information in a form easily understood by the user of the invention.

It is another object of this invention to provide a pitch determination and display system that is easily portable and low in cost.

For a better understanding of this present invention, together with other and further objects thereof, reference is made to the following description taken in connection with the accompanying drawings in which preferred embodiments of the invention are illustrated, the scope of the invention being pointed out and contained in the appended claims.

DESCRIPTION OF THE PREFERRED EMBODIMENTS

Figure 1:
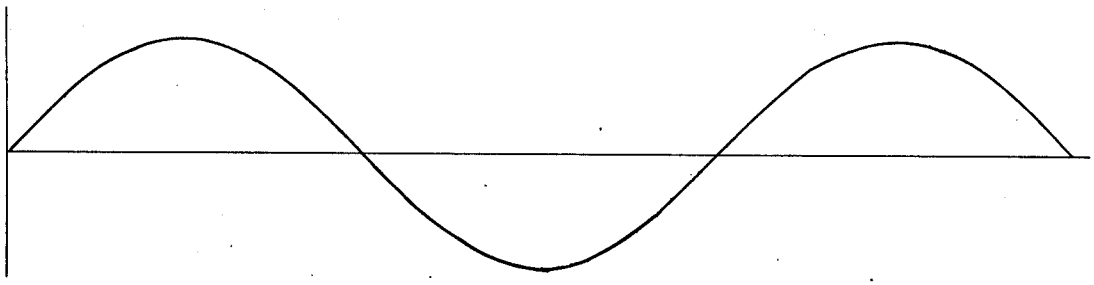
FIG. 1 demonstrates the kinds of signals that are of interest to the invention; direct frequency, carrier frequency, and peak detector output.
Figure 1:
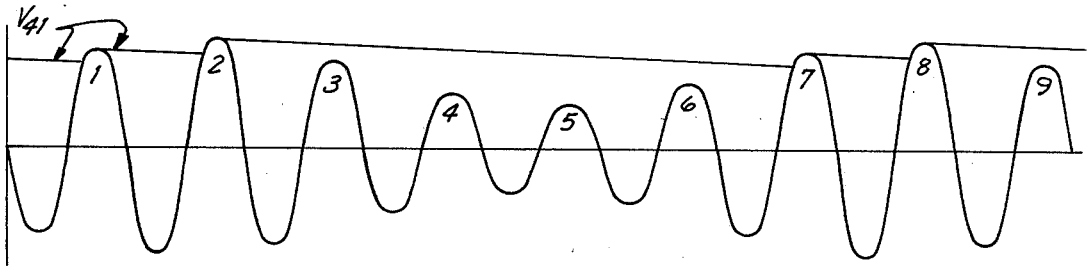
Figure 1:
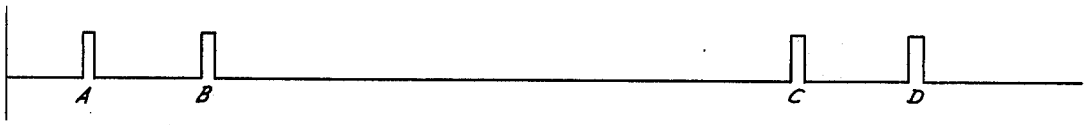

Pitch-determining prior art has been found to work well when used with signals similar to Signal 1 of FIG. 1. This type of a signal is generated by guitars and the like. It is also typical of the human voice when a relatively high note is sung very clearly, which is why prior art inventions have had some degree of success with the human voice. Signal 1 is termed here a direct frequency since its time representation waveform as drawn corresponds exactly to the pitch perceived by a listener.

When a singer shifts to the lower notes in his range, the voice mechanism shifts to a carrier frequency mode, wherein the perceived pitch is the amplitude modulation of a higher pitch, the higher pitch not being perceived by the listener. Signal 2 of FIG. 1 is a time representation waveform of a carrier frequency signal. The perceived pitch is the same as that of Signal 1. The direct frequencies present in the signal are 5 times, 6 times, and 7 times higher than the perceived frequency. Prior art that relies upon multiple tuned circuits will give multiple outputs, none of which would be correct. Prior art that essentially counts zero crossings would also given an incorrect reading.

It should be emphasized, although it is abvious to one skilled in the art, that the signals drawn in FIG. 1 are in themselves gross simplifications of what is actually seen. Other harmonics of higher frequencies may be present, the ratio between carrier frequency and the perceived frequency will vary and the type of modulation may vary. For example, the amplitude of a trombone signal-carrier goes to essentially zero very soon after the initial peak, and stays low until the arrival of another initial peak. $V_{41}$ in FIG. 1 refers to the voltage on capacitor 41 described further herein.

Figure 2:
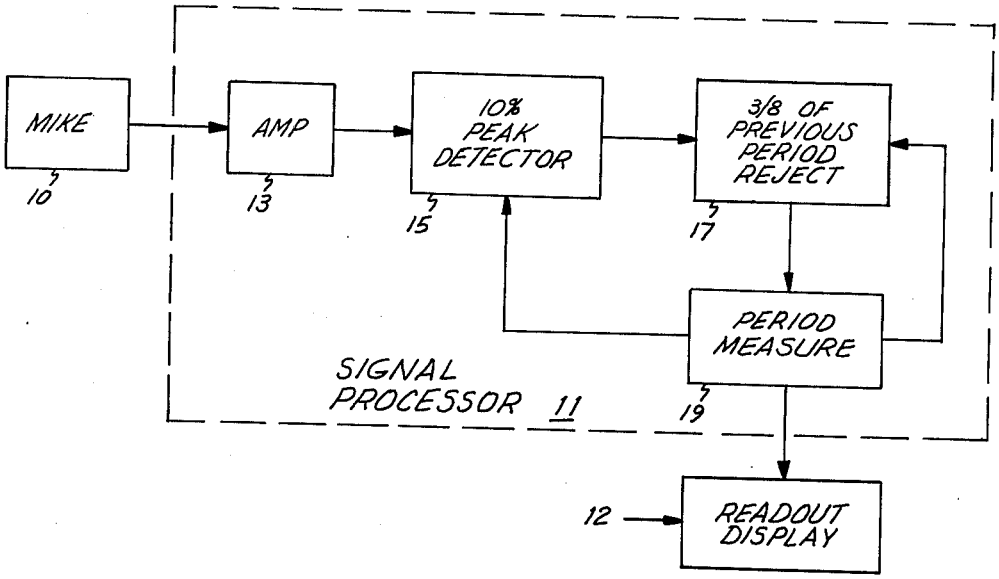
FIG. 2 provides the basic block diagram of the invention.

FIG. 2 presents a block diagram of the basic invention. A microphone 10 feeds a signal to a signal processor 11 which determines the period, i.e. the length of time between initial pulses, of the signal received from the microphone 10. The signal processor 11 drives an appropriate readout display 12. The signal processor 11 contains an amplifier 13 which may or may not have automatic gain control in it. The amplifier 13 drives a peak detector 15, whose operation is discussed in detail further herein. The peak detector 15 generates more pulses than are appropriate, so some of them are removed by the ⅜ period reject 17, whose operation also is discussed in detail below. The period measure circuit 19 provides the final determination of the period of the microphone 10 signal, and its output is fed back to the peak detector 15 and the ⅜ period reject 17 to optimize their performance. The output of the period measure circuit 19 drives the readout display 12.

Figure 3:
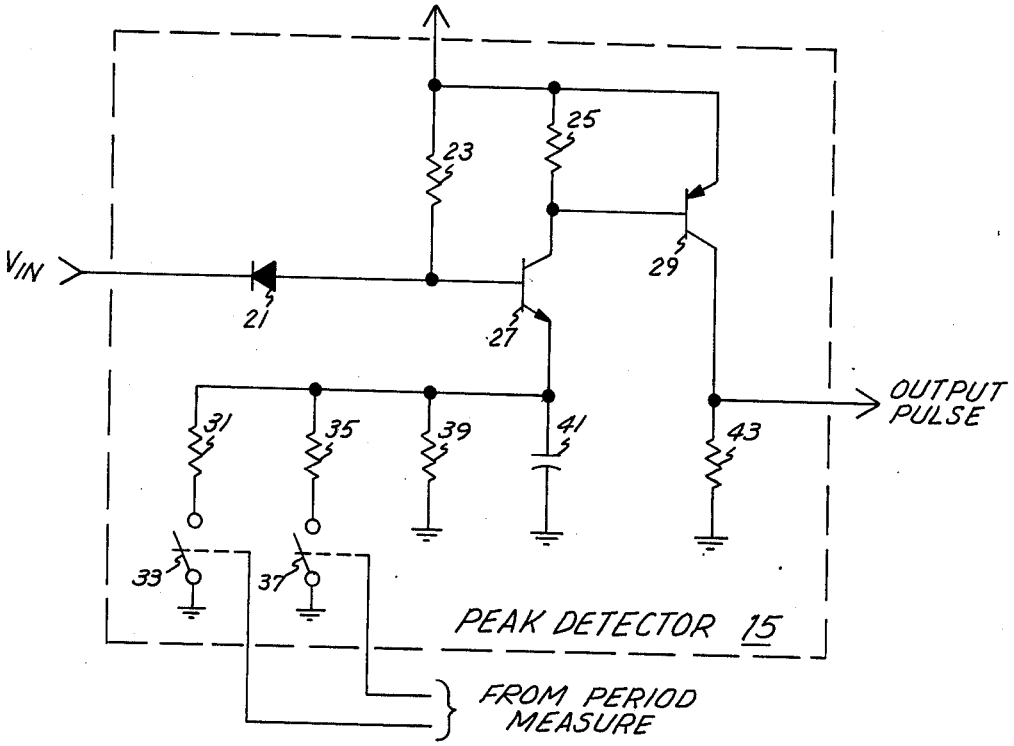
FIG. 3 shows a circuit for the peak detector.

FIG. 3 presents a circuit useful as the peak detector 15. Persons skilled in the art of analog circuit design will be able to develop other circuits which may perform the same function as will be described herein. Such other circuits are included in the spirit of the invention since it is the function, rather than the particular circuit, that constitutes a part of this invention. Consider Signal 2 of FIG. 1 as being applied to the input of the peak detector 15. The voltage at the junction of diode 21 and resistor 23 will ride approximately one diode drop above the input signal. When the voltage at the junction of diode 21 and resistor 23 exceeds the voltage on capacitor 41 by approximately one diode drop, transistor 27 will begin to conduct, and the voltage on capacitor 41 will rise in concert with a continued rise in the input voltage. The rise in the voltage of capacitor 41 requires current flow through transistor 27, which is spotted by the combined operation of resistor 25 and transistor 29. As long as capacitor 41 is charging, the current flow through transistor 27 will keep transistor 29 on so that the voltage drop across resistor 43 is large. As soon as the input voltage starts to fall, transistor 27 will turn off because the voltage at the junction of diode 21 and resistor 23 is falling while the voltage on capacitor 41 is staying essentially constant. The turnoff of transistor 27 causes transistor 29 to also turn off and the voltage across resistor 23 to go to zero. While the input voltage is swinging low, capacitor 41 discharges slowly through resistor 39 and, if the appropriate switches are closed, through resistors 31 and 35. If the next positive swing of the input voltage is less than the voltage remaining on capacitor 41 at that time, no output pulse will result. If the next positive swing of th input voltage exceeds the voltage remaining on capacitor 41 at that time, there will be another output pulse due to the action described above.

Consider now Signal 2 and Signal 3 of FIG. 1 in light of the preceding discussion of the peak detector 15. As shown, the voltage on capacitor 41 has decayed enough so that peak 1 of Signal 2 causes output pulse A of Signal 3. Peak 2 of Signal 2 is even higher than peak 1, so pulse B of Signal 3 results. Peak 3 of Signal 2 is considerably smaller than peak 2, so no output pulse results. Similarly, peaks 4, 5, and 6 of Signal 2 cause no output pulses. By the time peak 7 arrives, the voltage on capacitor 41 has fallen low enough so that pulse C of Signal 3 is generated. Since pulse 7 of Signal 2 corresponds to peak 1, a full cycle of operation is accomplished. The period to be measured is the time between pulses A and C of Signal 3, or the time between pulses B and D. How pulses B and D are rejected in favor of pulses A and C is discussed further herein.

It may be argued that a more gradual decay of the voltage on capacitor 41 would prevent the formation of pulses A and C since peak 1 is clearly smaller than peak 2. However, not all physical things are as regular as Signal 2 is, and peak 8 may be substantially lower in amplitude than peak 2. Thus a more gradual decay of the voltage on capacitor 41, while it would miss peak 7, may also miss peak 8, which would be a serious error. It has been found that having the voltage on capacitor 41 decay about 10% over the period being measured is a reasonable compromise for proper performance. This is the reason for the presence of switches 33 and 37 in FIG. 3; as the period being measured becomes progressively shorter, the rate of decay of the voltage on capacitor 41 is caused to be progressively faster.

There is further reason for not trying to make the decay of the voltage of capacitor 41 very shallow. There will often be other harmonics of higher frequency occurring along with the signals of interest in FIG. 1 which will cause multiple "nuisance" pulses on the output of the peak detector 15. It is necessary to remove these "nuisance" pulses even if the substantially misleading pulses A and C of Signal 3 did not exist. Thus, some form of multiple pulse rejection will always be required, so that making the decay of the voltage of capacitor 41 shallow runs the risk of missing important pulses while resulting in no advantages.

The function of the peak detector 15 is, then to generate an output pulse when an input peak pulse exceeds the previous peak input pulse less an amount proportional to the time that has elapsed since that previous pulse. Provision is included for changing the constant of proportionality in the peak detector 15.

Figure 4:
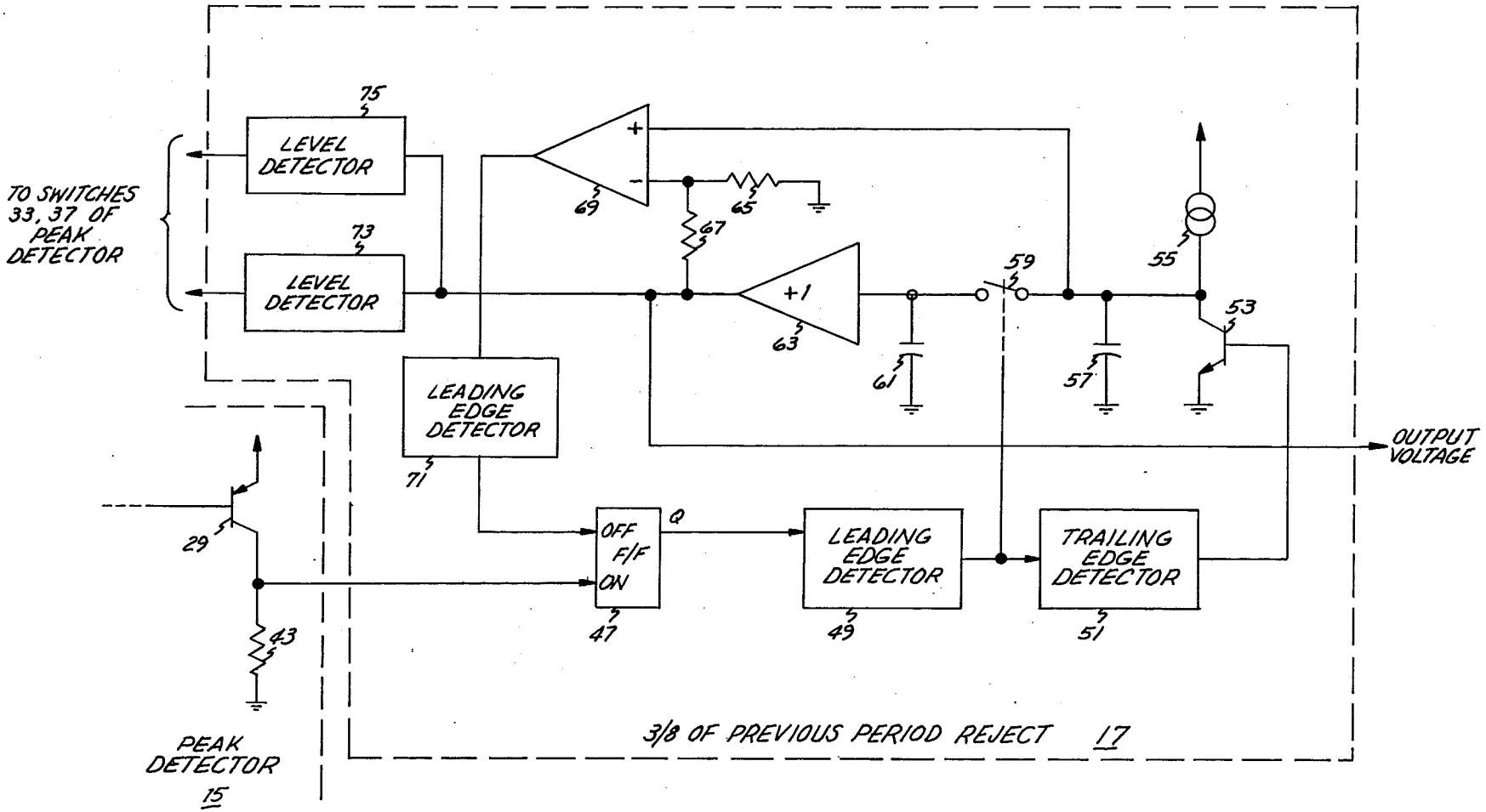
FIG. 4 shows an analog circuit for doing ⅜ period reject and period measurement.

FIG. 4 presents an analog circuit for performing the function of the ⅜ period reject 17. Persons skilled in the art of circuit design will be able to develop other circuits, both analog and digital, which can perform the same function as will be shortly described. Such other circuits are included in the spirit of the invention since it is the function, rather than the particular circuit, that constitutes a part of this invention.

A cycle of operation of the ⅜ period reject 17 circuit starts as the output of the Peak Detector 15 goes high and turns on flip-flop 47. The leading edge of the output of flip-flop 47 is detected by leading edge detector 49 which closes switch 59, allowing some of the charge on capacitor 57 to transfer to capacitor 61. In as much as capacitor 61 is small with respect to capacitor 57, the voltage on capacitor 57 will not change much as this transfer occurs. Indeed, if perchance the voltage on capacitor 61 is the same as the voltage on capacitor 57, there will be no disturbance of the voltage on capacitor 57 when the switch closes regardless of the relative sizes of the capacitors.

When the pulse out of the leading edge detector 49 finishes, switch 59 opens again. The finishing of the pulse from the leading edge detector 49 is detected by the trailing edge detector 51 which turns on transistor 53. This transistor 53 discharges capacitor 57 to approximately zero volts before transistor 53 is turned off again. When transistor 53 is off current source 55 starts to charge capacitor 57 and its voltage will rise linearily with time. Capacitor 61 will hold the voltage previously placed on it while this charging of capacitor 57 takes place. That is, capacitor 61 records the amplitude to which capacitor 57 was last charged.

Operational-amplifier 63 buffers capacitor 61 so that its voltage is available to the following circuits without causing it to decay significantly. Resistors 65 and 67 form a voltage divider network so that the output terminal of operational-amplifier (op-amp) 69 will remain negative as long as the voltage on capacitor 57 is less than ⅜ of the voltage on capacitor 61. As soon as the voltage on capacitor 57 exceeds this level, the output of op-amp 69 rises. This rise is detected by the leading edge detector 71 which in turn turns off flip-flop 47. While capacitor 57 charges up linearily with time, the circuit waits for another pulse from the output of the peak detector 15.

Several things are now worth noting. Pulses from the peak detector 15 that arrive after flip-flop 47 is turned on are ignored, which is the primary aim of the circuit. Once flip-flop 47 is turned on by pulse A of Signal 3 of FIG. 1, pulse B is ignored. Thus, the output pulse of leading edge detector 49 will occur simultaneously with pulses A and C of Signal 3 and constitute the period to be measured by the period measure circuit 19. Furthermore, the voltage on capacitor 61 is in fact representative of the period to be measured. Since capacitor 57 is reset regularly and charges linearly with time, the voltage transferred to capacitor 61 is proportional to the amount of time between resets. Thus this circuit is an analog period-measuring circuit as well, with its output voltage being linearly proportional to the measured period. That is why level detectors 73 and 75 can be connected to this output voltage and used to drive switches 33 and 37 of FIG. 3. It is useful to have some hysterysis in these level detectors 73 and 75 so that they are not continually cycling for pitches that are right on their thresholds. There will always be some vibrato, i.e. frequency variation, in the signal from the microphone and it would be unfortunate to have the decay time constant of capacitor 41 changing along with the vibrato. One might wind up with peak 7 of Signal 2 being detected at one time and not the next, which would lead to erroneous results. It is worth noting that while only two level detectors are shown, a multitude of detectors may be employed along with further switches other than 33 and 37 in FIG. 3, thereby achieving yet finer control over the decay time of capacitor 41, with the final determination being a cost versus effectiveness tradeoff. Experience has shown that one less level detector and switch are required than the signal processor 11 has octaves of range.

The choice of ⅜ is a result of an accuracy versus range tradeoff. If the signal processor 11 will have to handle less than an octave range of pitches, the ratio of resistors 65 and 67 can be changed so that the negative terminal of Op-amp 69 sees ⅞ of the voltage on capacitor 61. One may then be assured that a stray blip from the microphone 10 will be rejected and will not degrade the measuring process. However, if the signal processor 11 must handle two or more octaves, and the period reject is set at $\beta$, there is a chance that the signal processor 11 will lock onto a sub-multiple of the microphone 10 signal. That is, the ⅞ reject circuit might get into the mode of rejecting both pulses C and D of signal 3 and responding to the next pulse bebyond the boundary of the drawing. If octave information is unimportant, then ⅞ reject is satisfactory. But it is not possible for a ⅜ period reject circuit 17 to similarly lock onto the wrong octave.

In summary, the function of the ⅜ period reject circuit 17 is to reject those pulses which occur too soon after a pulse has been accepted because they cannot possible be valid pulses. The criterion for rejection is that the stray pulses occur within ⅜ of the previously measured period after the acceptance of a valid pulse.

The signal processor 11 which has been described thus far provides an analog signal which is linearly proportional to the period of the signal from the microphone 10. This analog signal may be used to drive a meter movement either with or without a log converter in between the signal processor and the meter. The accuracy of the meter readout will depend on the degree of care with which the signal processor has been built. If the absolute value of a microphone 10 signal is less interesting than the results to be obtained by comparing two signals, the latter system as shown in the block diagram of FIG. 5 will be of significance since it is another adaptation of this invention. The microphone 10 drives signal processor 77 while a second signal source 81 drives a second signal processor 79. The outputs of the two signal processors drive the comparators 85 including its accompanying supporting logic. The output of comparators 85 are shown to drive a Mike Signal-High Indicator 87 and a Mike Signal-Low Indicator 89. Differently-formatted output indicators can be easily imagined, such as giving no output indication when the microphone signal is within specified error limits from the second signal source 81.

It should be noted that if the signal processors are built per FIG. 4 the absolute accuracy of this analog circuitry need not be very good. Indeed, it is only the relative accuracy that is of importance. While it might be difficult to build a circuit of FIG. 4 which is accurate to 1% over a 4 octave range, it is not at all difficult to make two processors that track each other accurately to 0.1% over a 4 octave range. Thus, a comparative system for judging the accuracy with which a musician may match a selected pitch can be built fairly economically.

Figure 5:
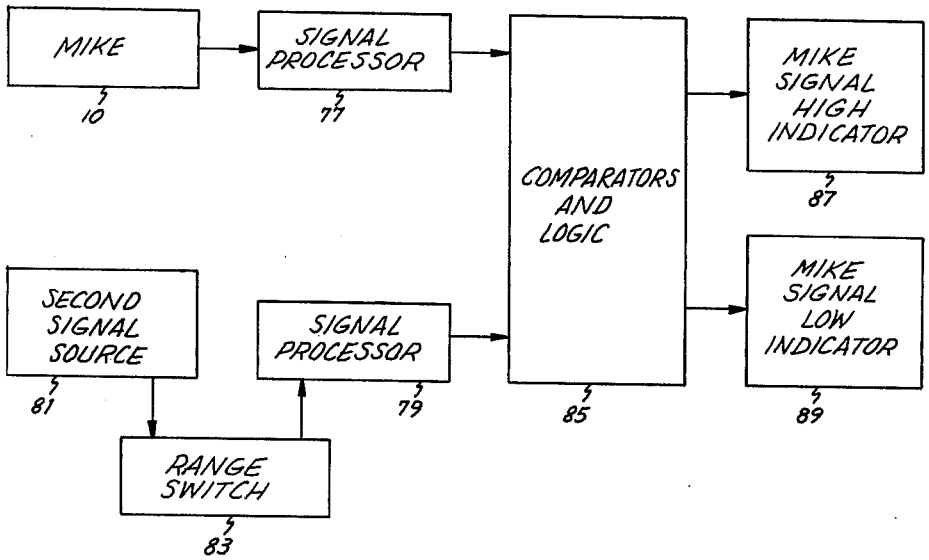
FIG. 5 shows a block diagram of a comparative system incorporating the use of this invention.

The purpose of the range switch 83 in FIG. 5 is as follows: Suppose that a musician elects to reproduce various pitches presented in some sequence from a tape recorder or a music synthesizer. It is well known that the range of pitches attainable by a soprano are vastly different than those attainable by a basso. The range switch 83, therefore, allows the user of the comparative system to make adjustment for the selected pitch range. For example, the tape recorder or frequency synthesizer can be set up for frequencies between Middle C and two octaves up therefrom, and a soprano would set the range switch 83 to its first position, and would then sing the selected pitches. A basso, on the other hand, would set the range switch 83 to another position to divide the second signal source 81 output by 4. He would then proceed to produce pitches in a range extending from two octaves below Middle C up to Middle C. Thus, the master tape for a tape recorder, or the program of notes for the frequency synthesized, need be made up only once in order to be useable by a variety of musicians.

Figure 6:
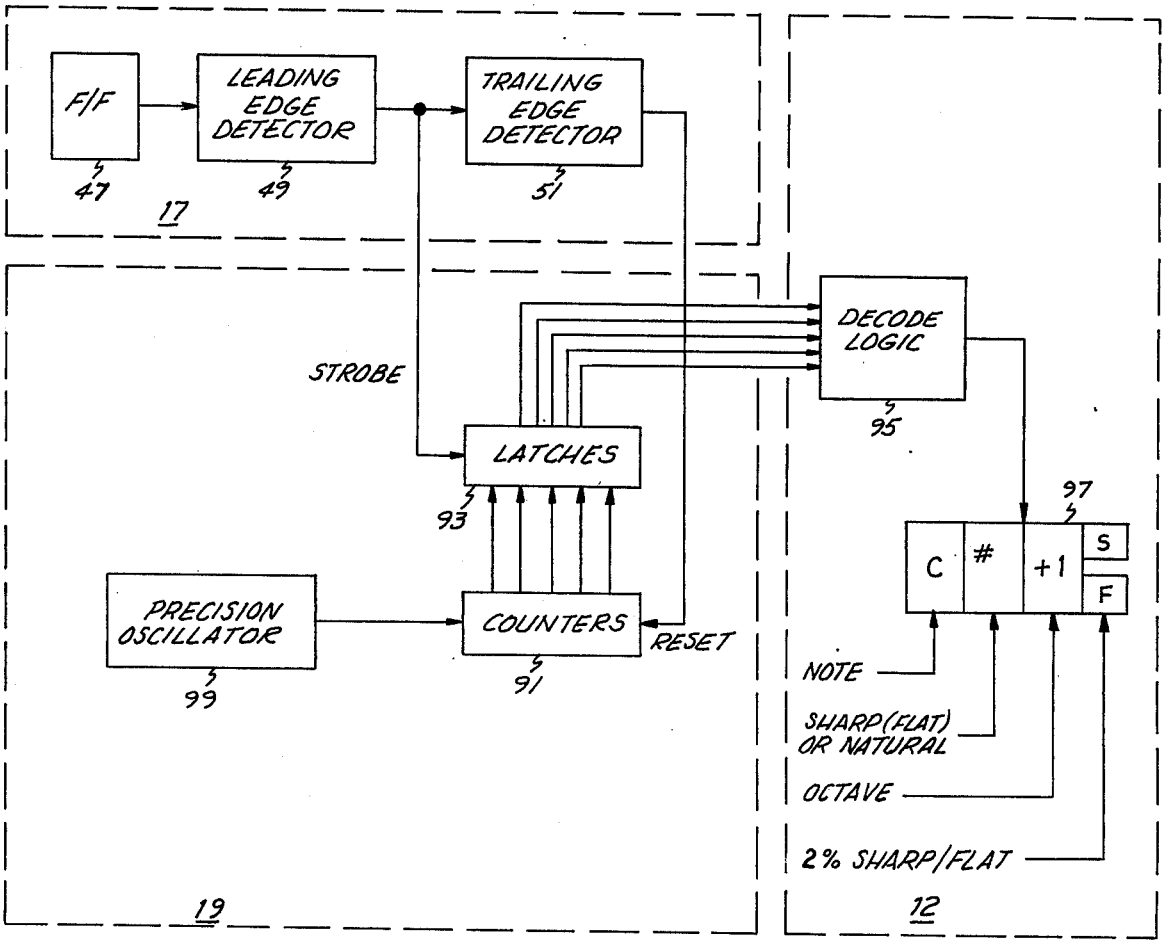
FIG. 6 provides a block diagram of a digital circuit for period measurement and the preferred output.

FIG. 6 presents a block diagram for a digital circuit for measuring the period of the pulse train from the ⅜ period reject circuit 17. Flip-flop 47, leading edge detector 49 and trailing edge detector 51 of FIG. 4 are presented once more in FIG. 6 for clarity. The output of leading edge detector 49 is used to strobe the contents of counters 91 into temporary storage elements, or latches 93. Then the trailing edge detector 51 resets the counters 91 to zero so that they can count up again. The counters 91 count pulses from a precision clock 99 which can be a crystal-controlled oscillator with accuracies of 0.01%. The length of the counters 91 and the corresponding number of latches 93 will depend on the range over which this circuit need operate and the resolution wanted in the final display 97. With this system it is quite easy to obtain 0.1% resolution for the highest note to be produced. The output display 97 is driven from the latches 93 through some decode logic 95 which can be built from random or combinational logic, read-only memories, programmable-logic arrays, or any other readily available type.

While the display 97 may be one of many various forms, it appears that a dignital display is the most useful type to a practicing musician. A series of lights behind a music staff, as shown in numerous prior art patents, could be driven just as easily with this system and would be more useful for introducing music concepts to students. The preferred format display first indicates the note measured, e.g. A, G, C, etc. Next, there is an indication of whether the natural note, or its sharp or flat is produced, for example, C sharp or C flat. Third, the octave that the note falls into is indicated, with either M or no indication indicating the octave immediately above Middle C, a +1 indicating the octave above that octave, a −1 indicating the octave below Middle C, etc. Finally, there is a sharp/flat indicator of two segments, one located above the other, with a space in between. If the microphone 10 signal is within ±1% of a standard pitch, neither of these indicators will be on. If the microphone 10 signal is between +1% and +3% above a standard pitch, the sharp indicator will come on. If the microphone 10 signal is −15 to −3% below a standard pitch, the flat indicator will come on.

What is claimed as new is:

1. An improved pitch determining and display system comprising, in combination:

a. signal generating means for providing a signal which corresponds to pitch produced by a musician said signal generating means comprising a microphone for picking up the sounds produced by a musician and translating the sounds into corresponding electronic signals;

b. signal processing means for determining the pitch produced said means being connected to the signal generating means and driven by the electronic signals generated by said microphone, said signal processing means comprising:

i. amplifier means connected to the microphone for amplifying the signal produced by the microphone:

ii. peak detector means connected to the amplifier means for providing an output pulse when an input peak pulse from the amplifier means exceeds a previous input pulse less an amount proportional to the time that has elapsed since the previous input pulse;

iii. inhibit means connected to the peak detector means for inhibiting the transmission of pulses which arrive during a period immediately following each accepted pulse, while transmitting onward acceptable pulses, the period being approximately ⅜ of the time between acceptable pulses; and iv. period measuring means connected to the inhibit means and the peak detector means for providing a signal proportional to the time between peak detector means-input pulses, the single being fed back to the inhibit means; and c. display means connected to the signal processing means for translating the determined pitch into convenient musical notation, said display means being adapted to receive the signal from said period measuring means.

2. The pitch determining and display system of claim 1, wherein the output of the period measuring means is fed back to the peak detection means to provide the most appropriate constant of proportionality for the period of the signal entering the signal processing means.

3. The pitch determining and display system of claim 2, wherein the display means is a digital readout display for providing pitch information in convenient musical notation.

4. The pitch determining and display system of claim 1 wherein the display means comprises a readout display having four digits, one digit indicating the note A, B, C, D, E, F, or G, another digit being either blank or superscript # to indicate the sharp of the basic note, another digit showing a blank when the determined pitch is in the octave immediately above Middle C or +1 or −1 when the determined pitch is respectively above or below that octave, or +2 or −2 when the determined pitch is respectively above or below the previously described ocataves, etc., the remaining digit being subdivided into three equal vertically organized segments, the top segment indicating that the determined pitch is 1% to 3% higher than the closest standard music notation pitch, the middle segment being either blank or indicating that the determined pitch is within + or −1% of the closest standard music pitch, the bottom segment indicating that the determined pitch is 1% to 3% lower than the closest standard music pitch.

5. The pitch determining and display system of claim 4, above, wherein one of the digits is either blank or superscript *b* to indicate the flat of the basic note.

6. The pitch determining and display system of claim 1 further comprising:

a. second signal generating means for providing a second signal which corresponds to a pitch intended to be produced by a musician;

b. means for comparing the output signal to the microphone driven signal processing means with the second signal; and c. means for displaying the differences in the compared signals in convenient musical notation.

7. The pitch measuring and display system of claim 6, above, further comprising a user-operated switch connected to the second signal generating means for selecting the range over which the second signal can vary whereby the second signal generating means may be programmed to operate over a selected moderate frequency range anywhere within the total operational range capability of the system.

8. The pitch determining and display system of claim 6, above, wherein the means for displaying the differences in the compared signals comprises a plurality of indicators, one of said indicators being a mike signal high indicator and the other being a mike signal low indicator.

9. Improved electronic signal processing circuitry comprising:

a. amplifier means for amplifying an electronic signal supplied to the input thereof;

b. peak detector means connected to the amplifier means for providing an output pulse when an input peak pulse from the amplifier means exceeds a previous input pulse less an amount proportional to the time that has elapsed since the previous input pulse;

c. inhibit means connected to the peak detector means for inhibiting the transmission of pulses which arrive during a period immediately following each accepted pulse, while transmitting onward acceptable pulses, the period being approximately ⅜ of the time between acceptable pulses; and d. period measuring means connected to the inhibit means and the peak detector means for providing a signal proportional to the time between peak detector means-input pulses, the signal being fed back to the inhibit means and also being fed forward for readout purposes.

10. The improved electronic signal processing circuitry of claim 9, above, wherein the output of the period measuring means is fed back to the peak detection means to provide the most appropriate constant of proportionality for the period of the signal entering the signal processing means.

* * * * *